US011469028B2

(12) United States Patent
Yen et al.

(10) Patent No.: US 11,469,028 B2
(45) Date of Patent: Oct. 11, 2022

(54) INDUCTOR DEVICE

(71) Applicant: Realtek Semiconductor Corporation, Hsinchu (TW)

(72) Inventors: Hsiao-Tsung Yen, Hsinchu (TW); Yuh-Sheng Jean, Hsinchu County (TW); Ta-Hsun Yeh, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 938 days.

(21) Appl. No.: 16/161,488

(22) Filed: Oct. 16, 2018

(65) Prior Publication Data

US 2019/0214175 A1 Jul. 11, 2019

(30) Foreign Application Priority Data

Jan. 8, 2018 (TW) ..... 107100682

(51) Int. Cl.
*H01F 17/00* (2006.01)
*H01F 17/02* (2006.01)
(Continued)

(52) U.S. Cl.
CPC ..... *H01F 17/0013* (2013.01); *H01F 17/02* (2013.01); *H01F 19/00* (2013.01);
(Continued)

(58) Field of Classification Search
CPC .. H01F 17/0013; H01F 17/02; H01F 27/2804; H01F 27/2823
See application file for complete search history.

(56) References Cited

U.S. PATENT DOCUMENTS 4,613,843 A 9/1986 Esper et al.
5,970,604 A 10/1999 Person et al.
(Continued)

FOREIGN PATENT DOCUMENTS

CN 101331586 A 12/2008
JP 2001060515 A 3/2001
(Continued)

OTHER PUBLICATIONS

U.S. Office Action of the related U.S. Appl. No. 15/972,645 dated Nov. 23, 2020.
(Continued)

*Primary Examiner* — Elvin G Enad
*Assistant Examiner* — Malcolm Barnes
(74) *Attorney, Agent, or Firm* — Locke Lord LLP; Tim Tingkang Xia, Esq.

(57) ABSTRACT

An inductor device includes a first and a second inductor. First inductor includes plural first wires and a first connection member. Second inductor includes plural second wires and a second connection member. Part of first wires are winded/located at a first area, and part of first wires are winded/located at a second area. First and second areas are located on two opposite sides of inductor device. First connection member connects first wire located at first area and located at second area. Part of second wires are winded/located at first area, and part of second wires are winded/located at second area. One terminal of second connection member connects a terminal of second wire at an inner side of inductor device, and another terminal of second connection member is disposed outside inductor device. First and second inductors are symmetrical with respect to a center line of inductor device.

20 Claims, 3 Drawing Sheets

(51) Int. Cl.

| | |
|---|---|
| ***H01F 27/28*** | (2006.01) |
| ***H01F 27/29*** | (2006.01) |
| ***H01F 41/06*** | (2016.01) |
| ***H01F 19/00*** | (2006.01) |

(52) U.S. Cl.

CPC ..... *H01F 27/2804* (2013.01); *H01F 27/2823* (2013.01); *H01F 27/29* (2013.01); *H01F 41/06* (2013.01); *H01F 2017/0046* (2013.01); *H01F 2017/0073* (2013.01); *H01F 2027/2809* (2013.01)

(56) References Cited

U.S. PATENT DOCUMENTS

| | | | | |
|---|---|---|---|---|
| 6,097,273 | A * | 8/2000 | Frye | H01F 5/003 333/25 |
| 6,911,887 | B1 | 6/2005 | Uriu et al. | |
| 7,312,684 | B2 | 12/2007 | Aoki | |
| 7,626,480 | B2 | 12/2009 | Lee | |
| 8,198,970 | B2 | 6/2012 | Choi et al. | |
| 9,773,606 | B2 | 9/2017 | Yen et al. | |
| 10,283,257 | B2 | 5/2019 | Kim et al. | |
| 2007/0268106 | A1* | 11/2007 | Lee | H03H 7/42 336/200 |
| 2009/0066457 | A1* | 3/2009 | Uchida | H01F 27/2804 336/188 |
| 2009/0174515 | A1* | 7/2009 | Lee | H01F 27/2804 336/182 |
| 2009/0284339 | A1* | 11/2009 | Choi | H03H 7/42 336/200 |
| 2011/0018672 | A1* | 1/2011 | Papananos | H03H 7/42 336/200 |
| 2011/0043316 | A1* | 2/2011 | Yang | H01F 27/2804 336/192 |
| 2012/0119845 | A1* | 5/2012 | Lu | H01F 27/2804 333/26 |
| 2012/0146741 | A1* | 6/2012 | Yen | H01L 23/5223 333/25 |
| 2012/0242406 | A1* | 9/2012 | Ke | H01F 27/2804 330/195 |
| 2012/0299682 | A1* | 11/2012 | Tsai | H01F 19/04 336/192 |
| 2015/0130579 | A1 | 5/2015 | Kim et al. | |
| 2015/0310980 | A1* | 10/2015 | Yen | H01F 27/2804 336/200 |
| 2016/0028146 | A1 | 1/2016 | Zhang et al. | |
| 2016/0329281 | A1* | 11/2016 | Yen | H01L 23/5227 |
| 2017/0162318 | A1 | 6/2017 | Yen | |
| 2019/0131054 | A1* | 5/2019 | Calanca, Jr. | H01F 27/2804 |

FOREIGN PATENT DOCUMENTS

| | | | |
|---|---|---|---|
| TW | 201335957 | A | 9/2013 |
| TW | 106120290 | | 6/2017 |
| TW | I598899 | B | 9/2017 |
| TW | 107107742 | | 3/2018 |
| TW | 107121033 | | 6/2018 |
| TW | I632661 | B | 8/2018 |

OTHER PUBLICATIONS

Chinese Patent Office, "Office Action", dated Aug. 23, 2019, China.

* cited by examiner

INDUCTOR DEVICE

RELATED APPLICATIONS

This application claims priority to Taiwan Application Serial Number 107100682, filed Jan. 8, 2018, which is herein incorporated by reference.

BACKGROUND

Field of Invention

The present disclosure relates to a basic electronic device. More particularly, the present disclosure relates to an inductor device.

Description of Related Art

Various types of prior art inductors have their own advantages and disadvantages, such as a spiral-type inductor. A spiral-type inductor has a higher quality value (Q value) and a greater mutual inductance value. However, both the mutual inductance and coupling of a spiral-type inductor occur between wires. For an eight-shaped inductor, since the magnetic fields induced by its two wires have opposite directions, the coupling and mutual inductance resulting from one wire are reflected by the coupled magnetic field resulting from the other wire. In addition, an eight-shaped inductor occupies a larger area in an apparatus. Additionally, although a stacked transformer occupies a smaller area, the Q value of a stacked transformer can not be optimized when compared with other types of transformers. As a result, the application ranges of the above inductor/transformer are all limited.

For the foregoing reasons, there is a need to solve the above-mentioned problems by providing an inductor device, which the industry is eager to achieve.

SUMMARY

The summary aims to provide a brief description of the disclosure so as to provide a basic understanding to the reader. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

One objective of the present disclosure is to provide an inductor device so as to improve the prior art problems.

An inductor device is provided. The inductor device comprises a first inductor and a second inductor. The first inductor comprises a plurality of first wires and a first connection member. The second inductor comprises a plurality of second wires and a second connection member. Part of the first wires are winded and located at a first area, and part of the first wires are winded and located at a second area. The first area and the second area are located on two opposite sides of the inductor device, respectively. The first connection member is configured to connect the first wire located at the first area and the first wire located at the second area. Part of the second wires are winded and located at the first area, and part of the second wires are winded and located at the second area. One terminal of the second connection member is configured to connect a terminal of the second wire located at an inside of the inductor device, and another terminal of the second connection member is disposed outside the inductor device. Both the first inductor and the second inductor are symmetrical with respect to a center line of the inductor device.

Therefore, the embodiments of the present disclosure provide an inductor device based on technical content of the present disclosure. By way of the symmetrical design of the two inductors of the inductor device, the problem that the efficacy of a common inductor device is usually influenced due to its asymmetrical structure is improved.

Many of the attendant features will be more readily appreciated as the same becomes better understood by reference to the following detailed description considered in connection with the accompanying drawings.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

According to the usual mode of operation, various features and elements in the figures have not been drawn to scale, which are drawn to the best way to present specific features and elements related to the present disclosure. In addition, among the different figures, the same or similar element symbols refer to similar elements/components.

DESCRIPTION OF THE EMBODIMENTS

To make the contents of the present disclosure more thorough and complete, the following illustrative description is given with regard to the implementation aspects and embodiments of the present disclosure, which is not intended to limit the scope of the present disclosure. The features of the embodiments and the steps of the method and their sequences that constitute and implement the embodiments are described. However, other embodiments may be used to achieve the same or equivalent functions and step sequences.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include the singular. Specifically, as used herein and in the claims, the singular forms “a” and “an” include the plural reference unless the context clearly indicates otherwise.

As used herein, “connect” refers to direct physical contact or electrical contact or indirect physical contact or electrical contact between two or more elements. Or it can also refer to reciprocal operations or actions between two or more elements.

Figure 1:
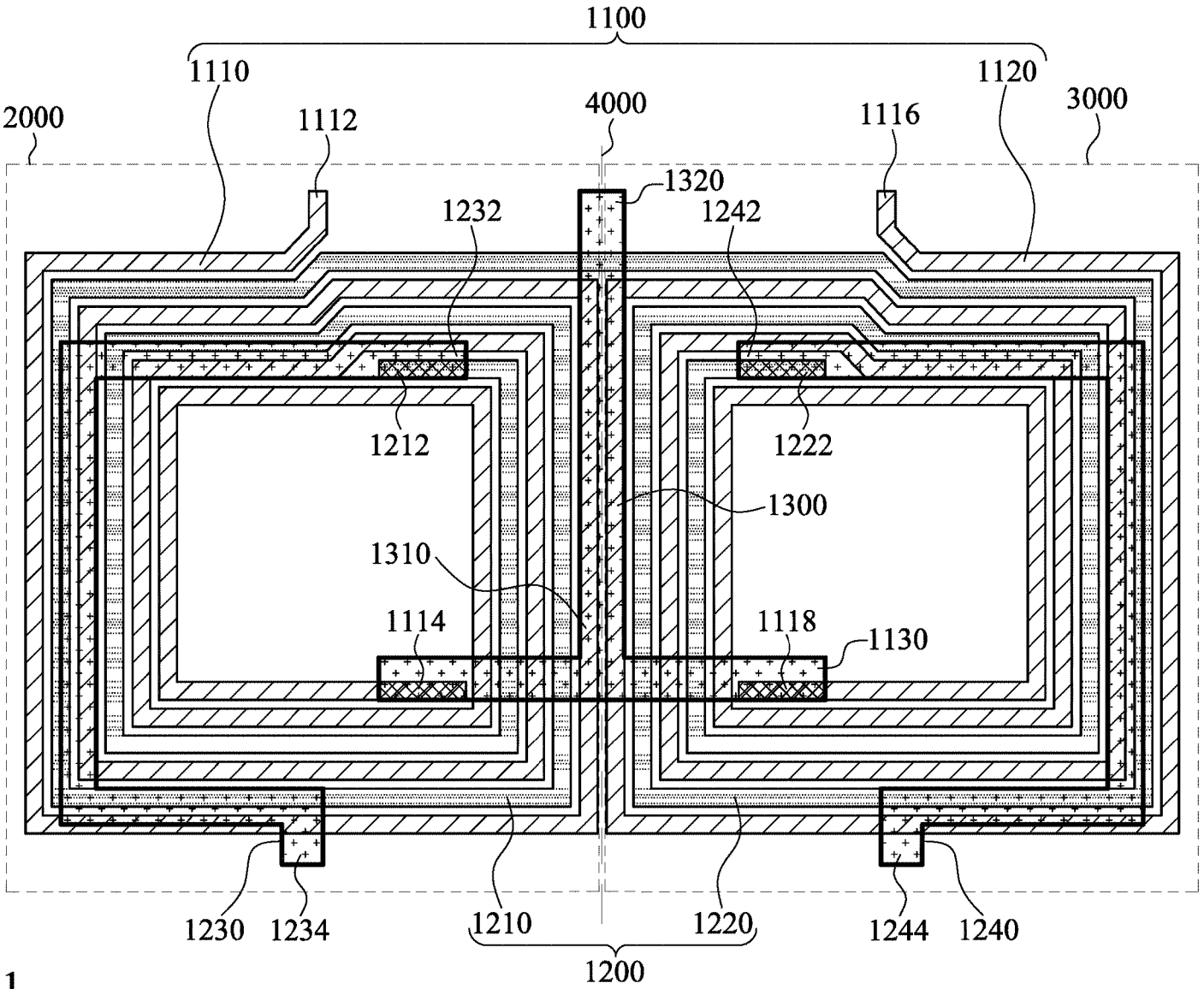
FIG. 1 depicts a schematic diagram of an inductor device according to one embodiment of the present disclosure.

FIG. 1 depicts a schematic diagram of an inductor device 1000 according to one embodiment of the present disclosure. As shown in the figure, the inductor device 1000 includes a first inductor 1100 and a second inductor 1200. The first inductor 1100 includes a plurality of first wires and a first connection member 1130. In addition, the second inductor 1200 includes a plurality of second wires and a second connection member 1230.

As shown in the figure, part of the first wires (such as wires 1110) are winded and located at a first area 2000. Part of the first wires (such as wires 1120) are winded and located at a second area 3000. Additionally, the first area 2000 and the second area 3000 are located on two opposite sides of the inductor device 1000, respectively. For example, the first area 2000 and the second area 3000 are respectively located on a left side and a right side of the inductor device 1000. However, the present disclosure is not limited in this regard. If the inductor device 1000 is rotated by 90 degrees, the first area 2000 and the second are 3000 are respectively located on an upper side and a lower side of the inductor device 1000. Additionally, the first connection member 1130 is configured to connect the first wire (such as the wire 1110) located at the first area 2000 and the first wire (such as the wire 1120) located at the second area 3000. For example, the first connection member 1130 is configured to connect a terminal 1114 of the first wire (such as the wire 1100) located at the first area 2000 and a terminal 1118 of the first wire (such as the wire 1120) located at the second area 3000.

In addition to that, part of the second wires (such as wires 1210) are winded and located at the first area 2000. Part of the second wires (such as wires 1220) are winded and located at the second area 3000. Additionally, one terminal 1232 of the second connection member 1230 is configured to connect a terminal 1212 of the second wire located at an inside of the inductor device 1000, and another terminal 1234 of the second connection member 1230 is disposed outside the inductor device 1000. In one embodiment, the second connection member 1230 includes a peripheral connection member that is disposed along the first wires 1110 and the second wires 1210. In other words, the peripheral connection member is disposed according to winding methods of the first wires 1110 and the second wires 1210. Hence, a shape of the peripheral connection member is a C-like shape. It is noted that the shape, a length, a width, and the like of the peripheral connection member may be disposed depending on practical needs to adjust an inductance value of the second inductor 1200 so as to increase the Q factor.

In addition, both the first inductor 1100 and the second inductor 1200 are symmetrical with respect to a center line 4000 of the inductor device 1000. For example, the terminal 1112 of the first inductor 1100 located at the first area 2000 is symmetrical to a terminal 1116 of the first inductor 1100 located at the second area 3000 with respect to the center line 4000 of the inductor device 1000. According to this logic, the wires 1110 of the first inductor 1100 are winded in such a manner that the wires 1110 of the first inductor 1100 are symmetrical to the wires 1120 of the first inductor 1100 with respect to the center line 4000, and the second inductor 1200 is also symmetrical with respect to the center line 4000. In greater detail, both the first inductor 1100 and the second inductor 1200 are mirror images with the center line 4000 as an axis. Additionally, as shown in the figure, the center line 4000 of the inductor device 1000 is located between the first area 2000 and the second area.

In still another embodiment, the first wires and the second wires are alternately arranged in the first area 2000 or the second area 3000. As shown in the figure, the first wires 1110 and the second wires 1210 are alternately arranged in the first area 2000, and so does the second area 3000. In greater detail, in the first area 2000 or the second area 3000, the first wires 1110 and the second wires 1210 are arranged in an alternate manner, that is, the first wire, the second wire, the first wire, the second wire, and so forth.

In another embodiment, the first wires include a plurality of first sub-wires 1110 and a plurality of second sub-wires 1120. As shown in the figure, the first sub-wires 1110 are winded and located at the first area 2000. The second sub-wires 1120 are winded and located at the second area 3000. The first sub-wires 1110 are independent of the second sub-wires 1120, and the first sub-wires 1110 and the second sub-wires 1120 are connected through the first connection member 1130. As shown in the figure, the first sub-wire 1110 may be winded towards an inside (for example, winded towards a center point of the first area 2000) at an angle of 45 degrees on an upper side of the first area 2000, and then winded towards the inside at an angle of 90 degrees at an upper left corner, a lower left corner, a lower right corner, and an upper right corner. After the first sub-wire 1110 is winded to the upper side again, other first sub-wire(s) 1110 are winded towards the inside at the angle of 45 degrees in a same manner to continuously wind an overall structure. In yet another embodiment, the second wires include a plurality of first sub-wires 1210 and a plurality of second sub-wires 1220. Take the first sub-wires 1210 for example. The first sub-wire 1210 may also be winded towards the inside at the angle of 45 degrees on the upper side of the first area 2000, and then winded towards the inside at the angle of 90 degrees at the upper left corner, the lower left corner, the lower right corner, and the upper right corner. After the first sub-wire 1210 is winded to the upper side again, other first sub-wire(s) 1210 are winded towards the inside at the angle of 45 degrees in the same manner to continuously wind an overall structure.

Figure 2:
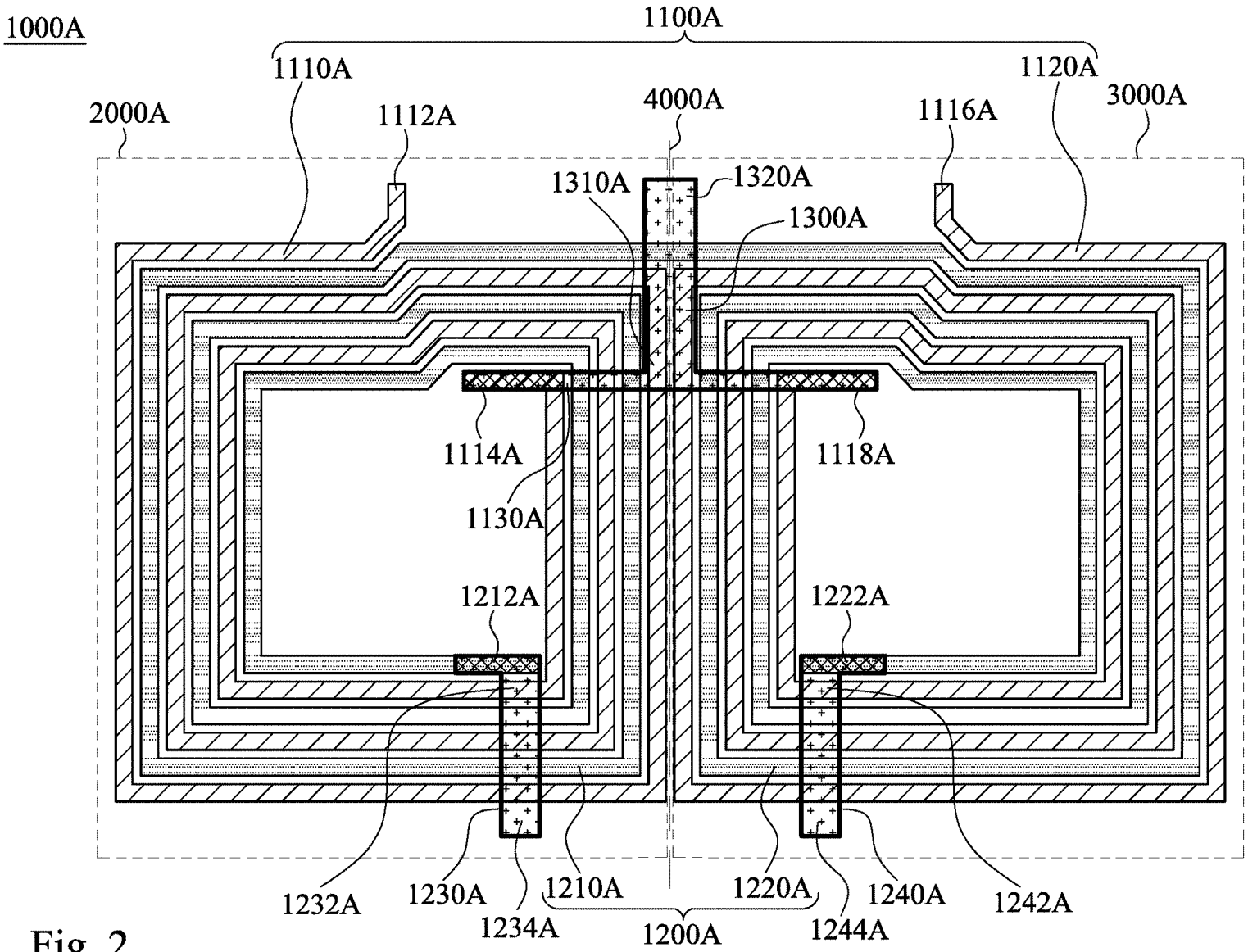
FIG. 2 depicts a schematic diagram of an inductor device according to another embodiment of the present disclosure.

In still another embodiment, the first inductor 1100 further includes the terminal 1112. The terminal 1112 of the first inductor 1100 and the another terminal 1234 of the second connection member 1230 are respectively located on two sides of the inductor device 1000, such as the upper side and the lower side in the figure. In one embodiment, the first connection member 1130 and the another terminal 1234 of the second connection member 1230 are located on a same side, such as the lower side in the figure. A description is provided with reference to FIG. 2. FIG. 2 depicts a schematic diagram of an inductor device 1000A according to another embodiment of the present disclosure. In another embodiment, an inductor device 1000A differs from the inductor device 1000 shown in FIG. 1 in that a first connection member 1130A and a terminal 1112A of the first inductor 1100A are located on a same side, such as an upper side in the figure.

With additional reference to FIG. 1, in one embodiment, the second connection member 1230 includes the first terminal 1232 and the second terminal 1234. The first terminal 1232 is configured to connect the terminal 1212 of the second wire located at the inside of the inductor device 1000 and at the first area 2000. The second terminal 1234 is disposed outside the inductor device 1000. In other words, the terminal 1212 of the second wire located at the inside can be connected to an outside through the second connection member 1230 so as to facilitate some other devices to connect the second wire through the second terminal 1234 of the second connection member 1230.

In another embodiment, the second inductor 1200 further includes a third connection member 1240. The third connection member 1240 includes a first terminal 1242 and a second terminal 1244. The first terminal 1242 is configured to connect a terminal 1222 of the second wire located at the inside of the inductor device 1000 and located at the second area 3000. The second terminal 1244 is disposed outside the inductor device 1000. In other words, the terminal 1222 of the second wire located at the inside can be connected to the outside through the third connection member 1240 so as to facilitate some other devices to connect the second wire through the second terminal 1244 of the third connection member 1240.

In still another embodiment, the second connection member 1230 includes a second peripheral connection member. The third connection member 1240 includes a third peripheral connection member. The second peripheral connection member and the third peripheral connection member are disposed along the first wires 1110, 1120 and the second wires 1210, 1220, respectively. In other words, the peripheral connection members are disposed according to winding methods of the first wires 1110, 1120 and the second wires 1210, 1220. Hence, a shape of the connection members is a C-like shape.

In one embodiment, the second peripheral connection member 1230 and the third peripheral connection member 1240 span the first wires 1110, 1210 and the second wires 1210, 1220, respectively. For example, the second peripheral connection member 1230 spans the first wires 1110 and the second wires 1210 simultaneously in the first area 2000.

In another embodiment, the second peripheral connection member 1230 and the third peripheral connection member 1240 are symmetrical to one another with respect to the center line 4000 of the inductor device 1000. In greater detail, the second peripheral connection member 1230 and the third peripheral connection member 1240 are mirror images with the center line 400 as the axis.

In still another embodiment, the inductor device 1000 further includes a central connection member 1300. The central connection member 1300 includes a first terminal 1310 and a second terminal 1320. The first terminal 1310 is connected to a center of the first connection member 1130. The second terminal 1320 is disposed outside the inductor device 1000, for example, disposed on the upper side in the figure. As shown in the figure, the central connection member 1300 is located on the center line 4000 of the inductor device 1000, and the center line 4000 is located between the first area 2000 and the second area 3000. However, the present disclosure is not limited to FIG. 1. One terminal of the central connection member 1130 may be connected to the center of the first connection member 1130, and another terminal is disposed towards the lower side in the figure.

In one embodiment, the central connection member 1300 spans the first wires 1110, 1120 and the second wires 1200. For example, the central connection member 1300 spans the first wires 1110, 1120 and the second wires 1200 simultaneously in an area where the center line 4000 is located.

It is noted that a structure of the inductor device 1000A shown in FIG. 2 is basically similar to a structure of the inductor device 1000 shown in FIG. 1. Except that the first connection member 1130 in FIG. 1 has a different configuration from the first connection member 1130A in FIG. 2, a difference between them is that a second connection member 1230A and a third connection member 1240A in the embodiment shown in FIG. 2 may be bar-shaped connection members, which are different from the C-shaped configurations shown in FIG. 1. In addition, take the first areas 2000, 2000A for example, the winding methods at their center parts are also slightly different. At the center part of the first area 2000 in FIG. 1, portions of the first wires 1100 have two adjacent turns in a left half part. On the contrary, there is no such configuration at the center part of the first area 2000A in FIG. 2.

Figure 3:
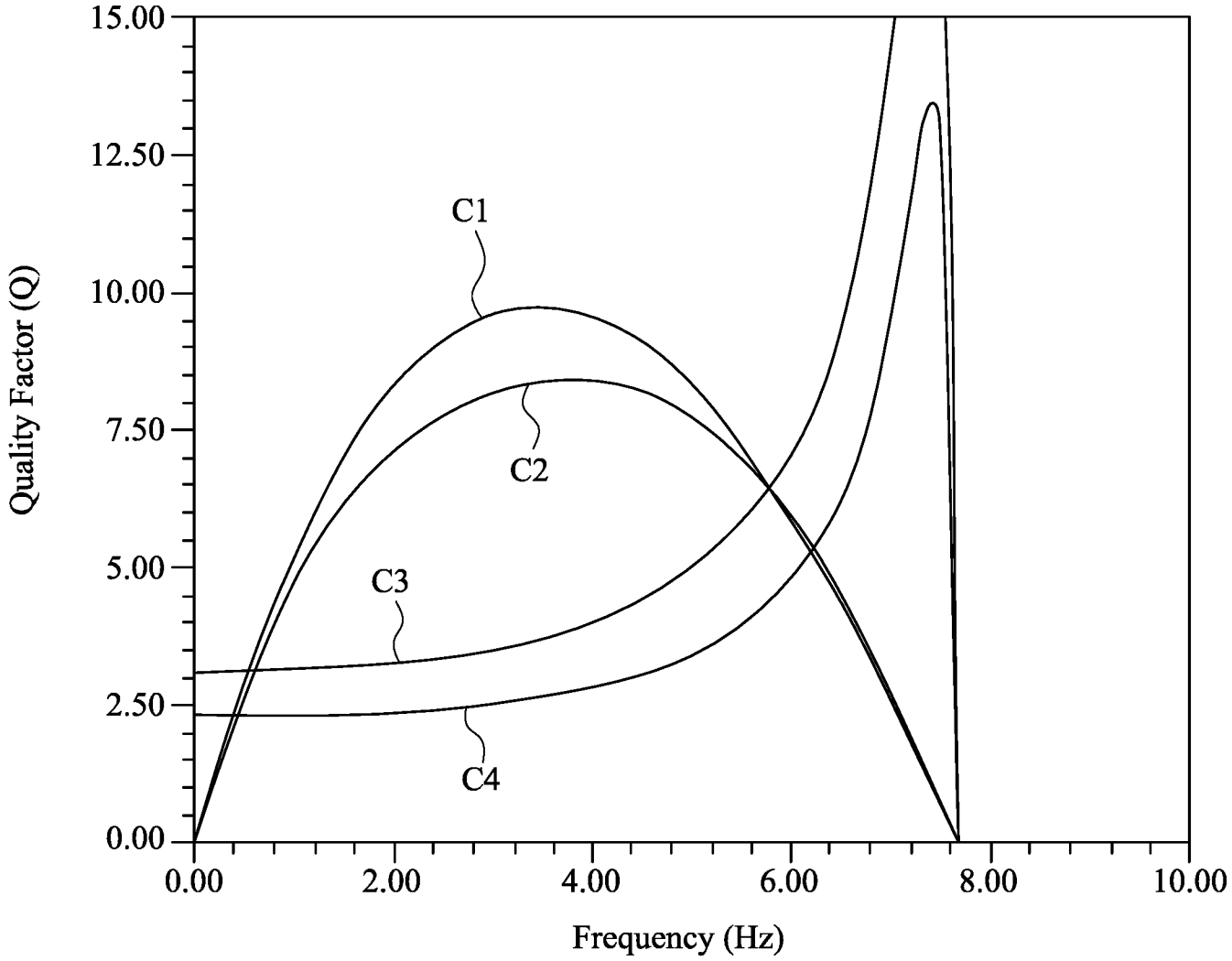
FIG. 3 depicts experimental data curves of an inductor device according to one embodiment of the present disclosure.

FIG. 3 depicts experimental data curves of an inductor device according to one embodiment of the present disclosure. The experimental data curves illustrate a Q factor and an inductance value of the inductor device under different frequencies. As shown in the figure, curve C1 is a quality factor curve of the first inductors 1100, 1100A of the inductor device 1000, 1000A according to the present disclosure. Curve C2 is a quality factor curve of the second inductor 1200 and a second inductor 1200A of the inductor device 1000, 1000A according to the present disclosure. Curve C3 is an inductance value curve of the first inductors 1100, 1100A of the inductor devices 1000, 1000A according to the present disclosure. Curve C4 is an inductance value curve of the second inductors 1200, 1200A of the inductor devices 1000, 1000A according to the present disclosure. It can be seen from the experimental data in FIG. 3 that the quality factors of the first inductors and the second inductors of each of the inductor devices can reach about 9 and 7.5, respectively. In addition to that, the inductance values of the first inductors and the second inductors are respectively 3.3 nH and 2.4 nH, and K value can reach 0.81. Therefore, the efficacy of the inductive device can be improved by symmetrically designing the two inductors of the inductor device according to the present disclosure. However, the present disclosure is not limited to the numerical values provided in the above embodiments, and those skilled in the art may adjust the above numerical values depending on practical needs to achieve the optimum efficacy.

It can be seen from the embodiments of the present disclosure that applying the present disclosure has the following advantages. The embodiments of the present disclosure provide an inductor device. Because the two inductors of the inductor device are designed to be very symmetrical, the efficacy of the inductor device is excellent to improve the problem that the efficacy of a common inductor device is usually influenced due to its asymmetrical structure. Additionally, as compared with a common inductor device, the inductor device according to the present disclosure improves the second harmonic, and increases the gain by about 2 dB and has a high quality factor (Q).

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inductor device comprising:

a first inductor comprising:

a plurality of first wires, wherein part of the first wires are winded and located at a first area, and part of the first wires are winded and located at a second area, wherein the first area and the second area are located on two opposite sides of the inductor device, respectively; and a first connection member configured to connect the first wire located at the first area and the first wire located at the second area; and a second inductor comprising:

a plurality of second wires, wherein part of the second wires are winded and located at the first area, and part of the second wires are winded and located at the second area; and a second connection member, one terminal of the second connection member being configured to connect a terminal of the second wire located at an inside of the inductor device, and another terminal of the second connection member being disposed outside the inductor device;

wherein both the first inductor and the second inductor are symmetrical with respect to a center line of the inductor device, wherein the first connection member and the one terminal of the second connection member are respectively located at two sides of the inductor device.

2. The inductor device of claim 1, wherein both the first inductor and the second inductor are mirror images with the center line as an axis.

3. The inductor device of claim 1, wherein the center line of the inductor device is located between the first area and the second area.

4. The inductor device of claim 1, wherein the first wires comprise:

a plurality of first sub-wires winded and located at the first area; and a plurality of second sub-wires winded and located at the second area, wherein the first sub-wires are independent of the second sub-wires, and the first sub-wires and the second sub-wires are connected through the first connection member.

5. The inductor device of claim 1, wherein the first inductor further comprises a terminal, wherein the terminal of the first inductor and the another terminal of the second connection member are respectively located on two sides of the inductor device.

6. The inductor device of claim 5, wherein the first connection member and the another terminal of the second connection member are located on a same side.

7. The inductor device of claim 5, wherein the first connection member and the terminal of the first inductor are located on a same side.

8. The inductor device of claim 1, wherein the first wires and the second wires are arranged in an alternate manner in the first area or the second area.

9. The inductor device of claim 8, wherein an arrangement of the first wires and the second wires in the first area or the second area is the first wire, the second wire, the first wire, and the second wire.

10. The inductor device of claim 1, wherein the second connection member comprises a peripheral connection member, wherein the peripheral connection member is disposed along the first wires and the second wires.

11. The inductor device of claim 10, wherein the second connection member comprises:

a first terminal configured to connect a terminal of the second wire located at the inside of the inductor device and at the first area; and a second terminal disposed outside the inductor device.

12. The inductor device of claim 11, wherein the second inductor further comprises:

a third connection member comprising:

a first terminal configured to connect a terminal of the second wire located at the inside of the inductor device and located at the second area; and a second terminal disposed outside the inductor device.

13. The inductor device of claim 12, wherein the second connection member comprises a second peripheral connection member, the third connection member comprises a third peripheral connection member, wherein each of the second peripheral connection member and the third peripheral connection member is disposed along the first wires and the second wires.

14. The inductor device of claim 13, wherein the second peripheral connection member and the third peripheral connection member span the first wires and the second wires.

15. The inductor device of claim 14, wherein the second peripheral connection member and the third peripheral connection member are symmetrical to one another with respect to the center line of the inductor device.

16. The inductor device of claim 15, wherein the second peripheral connection member and the third peripheral connection member are mirror images with the center line as an axis.

17. The inductor device of claim 1, further comprising:

a central connection member comprising:

a first terminal connected to a center of the first connection member; and a second terminal disposed outside the inductor device.

18. The inductor device of claim 17, wherein the central connection member is located on the center line of the inductor device.

19. The inductor device of claim 17, wherein the center line of the inductor device is located between the first area and the second area.

20. The inductor device of claim 17, wherein the central connection member spans the first wires and the second wires.

* * * * *